United States Patent [19]

Sprando

[11] 4,347,548

[45] Aug. 31, 1982

[54] ELECTRICAL RELAY

[76] Inventor: Anthony E. Sprando, 3115 NW. Cornell Rd., Portland, Oreg. 97210

[21] Appl. No.: 238,846

[22] Filed: Feb. 27, 1981

[51] Int. Cl.[3] ..... H01H 47/04

[52] U.S. Cl. ..... 361/210; 335/128; 335/266; 361/208

[58] Field of Search ..... 361/210, 208; 335/128, 335/266, 182, 183

[56] References Cited

U.S. PATENT DOCUMENTS 3,851,283 11/1974 Ault ..... 361/210

3,906,416 9/1975 Sprando ..... 335/128

*Primary Examiner*—Harold Broome

*Attorney, Agent, or Firm*—Adrian J. LaRue

[57] ABSTRACT

An electrical relay is provided with bifilar windings defining a first coil and a single winding defining a second coil. Each of the bifilar windings is connected in series with an RC network and this circuit is connected in parallel with the transmission line. When an AC current flows in the transmission line and through the bifilar windings and single winding, this does not cause the armature to move. When a DC current flows in the transmission line, it flows through the bifilar windings but is blocked by the RC network from flowing through the single winding which causes the leg of the armature to be attracted to the bifilar windings coil thereby operating the relay.

8 Claims, 5 Drawing Figures

ELECTRICAL RELAY

BACKGROUND OF THE INVENTION

A relay coil is connected in each line of a telephone circuit to operate the relay when the telephone is in use. The operation of each relay will operate auxillary circuits, such as lamps, registers, other relays, etc. These relays are quite large, susceptible to external vibration and very costly to manufacture. Each telephone line of the telephone circuit requires one of these relays to maintain proper electrical balance and they are not suitable for mounting on printed circuit boards due to their large size and weight.

SUMMARY OF THE INVENTION

The present invention relates to electrical relays and more particularly to electrical relays that are used in circuits that generate very small signal currents.

The present invention is realized by a relay having two coils, two bifilar windings are wound on the same core to form one coil and the second coil is a single winding wound on another core. One of the bifilar windings is connected in series with one transmission line and the other of the bifilar windings is connected in series with the other transmission line. The second coil is connected in parallel with the transmission lines and in series with an RC network. An AC current will flow through both coils balancing the armature, whereas a DC current will flow only through the bifilar windings and not through the second coil due to the RC network preventing passage of DC current therethrough which will cause the armature to be attracted to the core on which the bifilar windings are disposed to operate contact means thereof.

An object of the present invention is to provide an electrical relay that senses very small signal currents.

Another object of the present invention is the provision of an electrical relay that will not operate when AC current passes therethrough but will operate when DC current passes therethrough.

A further object of the present invention is to provide an electrical relay that includes bifilar windings to form one coil on one core and a single winding coil on another core with both cores being in association with an armature.

An additional object of the present invention is the provision of an electrical relay that includes bifilar windings forming one coil on one core and a single winding coil on another core with both cores being in association with an armature and an RC network in series with the single winding coil.

Still a further object of the present invention is to provide an electrical relay that is miniature in size, can be mounted on a printed circuit board, has a low profile and can be operated with very little power.

Additional objects and advantages will become apparent and the invention will be better understood with reference to the following description of a certain preferred embodiment illustrated in the accompanying drawings. Various changes may be made in the details of construction and arrangement of parts and certain features may be used without others. All such modifications within the scope of the appended claims are included in the invention.

DESCRIPTION OF THE INVENTION

U.S. Pat. No. 3,906,416 discloses a relay similar to the relay that is to be used in conjunction with the present invention.

Figure 2:
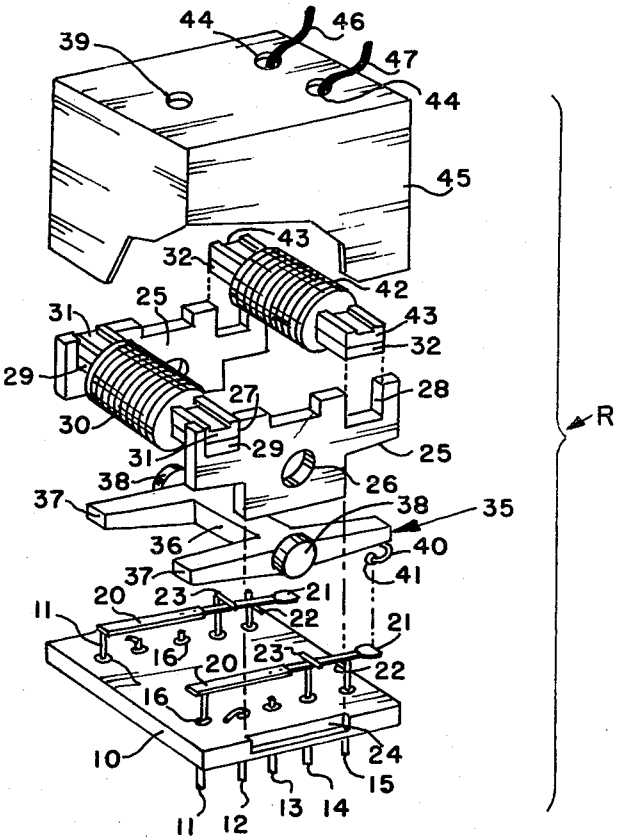
FIG. 2 is an exploded view of the relay in FIG. 1.
Figure 1:
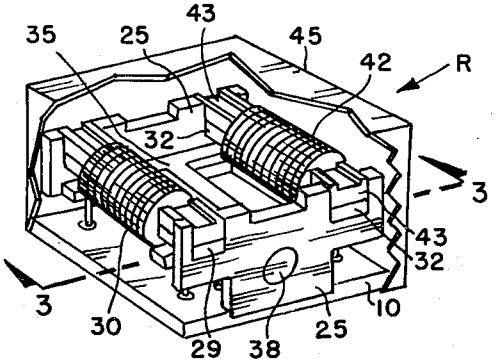
FIG. 1 is a perspective view of a sensitive relay embodying the invention, with parts broken away.
Figure 3:
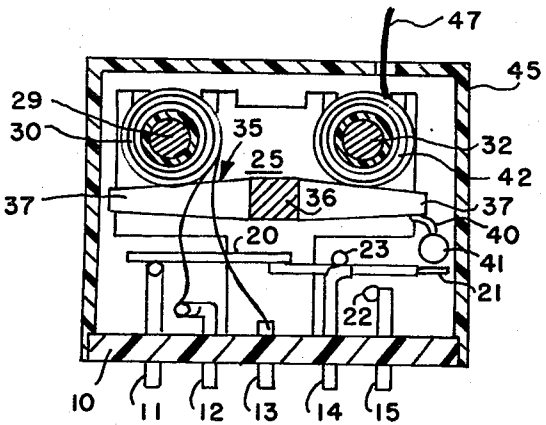
FIG. 3 is a cross sectinoal view of a sensitive relay on the line 3—3 in FIG. 1.

As shown in FIGS. 1, 2, 3, all parts of the relay R are mounted on a base or header 10 preferably made of a suitable thermoplastic material such as Delrin, manufactured by E. I. DuPont de Nemours & Co. Two pin assemblies mount the relay in sockets in a printed circuit board and establish external circuit connections to the coils and contacts in the relay.

A pin assembly comprises metal pins 11, 12, 13, 14, and 15. The pin assembly includes a bar of plastic material 16 which is molded around the pins to hold them in proper relationship as a unit. The bar 16 is preferably made of a suitable thermoplastic such as Ryton, manufactured by Phillips Petroleum Company, which will withstand soldering or welding temperatures. The plastic material of header 10 is molded around the bars 16 of the two pin assemblies, the Delrin having a higher shrink factor than the Ryton on cooling, causing the plastic in header 10 to form a compressive seal around each bar 16.

Another type of header to be used in place of header 10 is disclosed in U.S. Pat. No. 4,021,631.

An elastic metal reed 20 carrying a reed contact 21 is soldered or welded on pin 11. A lower fixed contact 22 is soldered or welded on pin 15 and an upper fixed contact 23 is soldered or welded on pin 14. The ends of a bifilar coil 30 are soldered or welded to the pins 12 and 13 in the two pin assemblies. The soldering or welding temperatures to which the pins are subjected are dissipated in the heat resistant plastic of bars 16 without softening or damaging the plastic of header 10.

Opposite sides of header 10 are notched at 24 to receive the lower ends of a pair of thermoplastic end frames 25 which are heat welded to the header. Each end frame 25 contains an armature-bearing hole 26 and a pair of slots 27 and 28 on opposite sides of this bearing.

A cylindrical iron flux collector core 29 carrying bifilar coil 30 has rectangular pole pieces on its opposite ends mounted in slots 27 in the two end frames 25. The core 29 is retained in the slots 27 by a pair of thermoplastic inserts 31 which are heat welded to the frames 25. There being only one bifilar coil in this relay, the opposite sides of the frames 25 include a cylindrical iron flux collector core 32 carrying coil 42 which has rectangular pole pieces on its opposite ends mounted in slots 28 in the two end frames 25. Core 32 is retained in slots 28 by a pair of thermoplastic inserts 43 which are heat welded to frames 25. The ends of coil 42 are soldered or welded to contacts 44 in cover 45 and wires 46, 47 are soldered or welded thereto.

The iron armature 35 is of H shape having an axial cross member 36 and two paralled radial arms 37 extending at right angles to cross member 36 at its opposite ends. The end of cross member 36 are equipped with a pair of pivot pins 38 which rotate in the bearing holes 26 of the frames 25. The armature is symmetrical about the axis of pivot pins 38 whereby it is balanced on its center of mass and is not disturbed by external vibration or acceleration forces. The arms 37 carry a pair of torque arms 40 having glass beads 41 to engage and actuate reed contacts 21 on the two pin assemblies when bifilar coil 30 is energized and coil 42 is deenergized.

The entire structure is sealed within thermoplastic shell 45 which is heat welded to header 10. After assembly, the air is evacuated from the shell through a small hole 39 and replaced by nitrogen and the hole is heat sealed. The complete relay shown in FIG. 1 is 0.6 inch wide, 0.6 inch long and 0.4 inch high. However, no limitation is intended as to specific dimensions.

The relay shown in FIGS. 1 and 2 having the single energizing bifilar coil 30 and coil 42 is designated as a sensitive relay. With reference to FIG. 3, resilient reed 20 normally biases reed contact 21 against upper stationary contact 23 and biases armature 35 counterclockwise away from the pole faces of core 29 and toward backstop member 32. When coil 30 is energized and coil 42 is not energized, the two armature arms 37 are attracted to the north and south pole faces on opposite ends of core 29, rotating the armature clockwise and causing torque arm 40 to shift reed contact 21 from stationary contact 23 to stationary contact 22.

The same switching event occurs at the other set of contacts associated with the second pin assembly shown in FIG. 2 whereby the entire switch mechanism functions as a double-pole, double-throw switch. When coils 30 and 42 are deenergized, the reeds 20 rotate the armature 35 counterclockwise and return both reed contacts 21 to the upper stationary contacts 23.

When coils 30 and 42 are energized at the same time, coil 42 acts as a bucking coil bucking the action of bifilar coil 30 so that armature 35 remains in a stationary condition and does not move.

Figure 4:
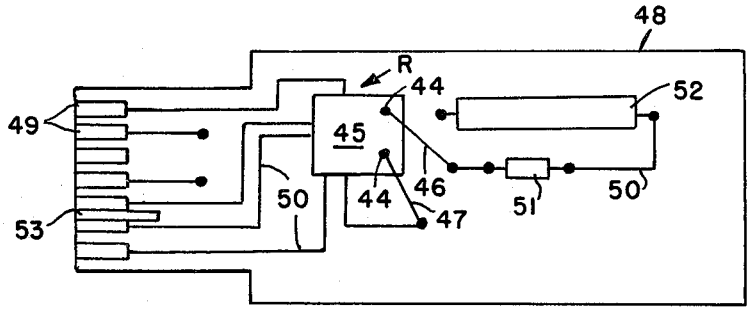
FIG. 4 illustrates a printed circuit card incorporating the present invention.
Figure 5:
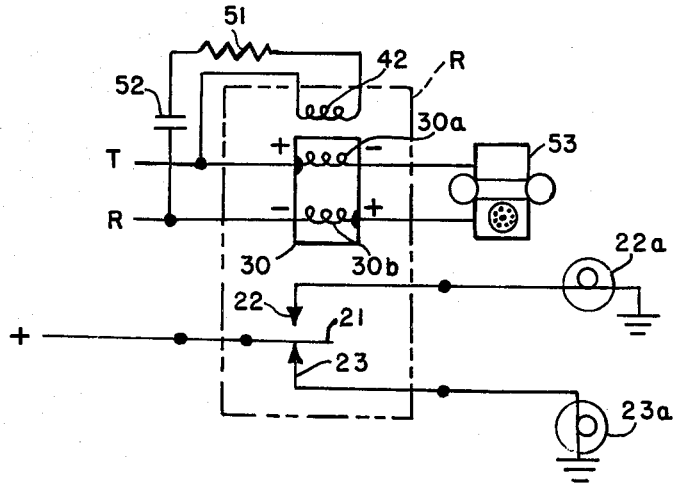
FIG. 5 is a schematic diagram of a use of the invention.

FIGS. 4 and 5 illustrate a printed circuit board and a schematic diagram of a use of the invention. A printed circuit board 48 has tabs 49 connected to conductive paths 50 on each side thereof. Relay R, resistor 51 and capacitor 52 are soldered to conductive paths 50. Board 48 has a slot 53 in the tab end to enable board 48 to be plugged correctly into an edge connector (not shown) to connect the relay circuit formed by relay R, resistor 51 and capacitor 52 with, for example, a telephone line T, R connected to a telephone 53.

As shown in FIG. 5, winding 30*a* of bifilar coil 30 is connected in series with line T and winding 30*b* is connected in series with line R. Coil 42 is in series with resistor 51 and capacitor 52 and this circuit is connected in parallel with lines T and R. Normally closed contacts 21 and 23 cause red lamp 23*a* to be energized signifying the line is not busy. Bifilar windings 30*a* and 30*b* of coil 30 are balanced windings so that when AC ringing current is generated along lines T and R to operate the ringing circuit in telephone 53, RC network 51 and 52 permit the AC current to flow through coil 42 which creates a bucking current to offset the current flowing through coils 30*a* and 30*b* of coil 30.

This action maintains armature 35 in a stable nonoperating position. When telephone 53 is answered or off hook, the ringing circuit is disconnected from lines T and R and the talking circuit is connected to lines T and R which now constitutes DC current. The cessation of AC ringing current and the commencing of DC current causes DC current to flow in coils 30*a* and 30*b* of coil 30 and this DC current is blocked from reaching coil 42 via RC network 51 and 52 so that coil 30 attracts legs 37 or armature 35 causing armature 35 to pivot about pivots 38 and glass beads 41 engage and actuate reed contacts 21 so that contacts 21 are moved away from contacts 23 and make contact with contacts 22 thereby deenergizing lamps 23*a* and energizing green lamp 22*a* signifying the line is busy.

Thus, relay of the present invention can effectively be used to sense small signal currents in communication networks and indicate change of state conditions such as when a telephone is in use or not in use. The present invention can of course be used in conjunction with lines in which AC current is being transmitted and DC current is on the lines when the AC current is interrupted .

Although the invention has been described as hereinbefore set forth, it will be appreciated that various changes and modifications may be made therein without departing from the scope of the invention as claimed in the accompanying claims.

The invention is claimed in accordance with the following;

1. An electromagnetic relay for use with a transmission line that transmits AC current under one condition and DC current under another condition, said relay comprising:

base plate means of insulating material having stationary contact means and movable contact means thereon;

frame means mounted on said base plate means;

armature means of magnetizable material having a cross member and arm means extending outwardly from opposite sides of said cross member;

means pivotally mounting said armature means to said frame means about an axis extending through said cross member with said arm means being disposed in a plane which is substantially parallel to said base plate means so that said arm means can move toward and away from said base plate means;

first coil means disposed adjacent one of said arm means and having bifilar windings for series connection with the transmission line;

second coil means disposed adjacent the other of said arm means and having a single winding;

means for connecting said single winding in parallel with the transmission line to block flow of DC current to said single winding so that when AC current flows in the transmission line the AC current flows in said bifilar windings and said single winding causing said armature means to remain stationary, but, when DC current flows in the transmission line, said connecting means blocks flow of DC current to said single winding so that said bifilar windings attract said one arm means to said first coil means; and actuating means on said armature means for engaging said movable contact means for moving said movable contact means into engagement with and disengagement with said stationary contact means when said one arm means is attracted to said first coil means.

2. An electromagnetic relay according to claim 1 wherein said armature means has an H configuration.

3. An electromagnetic relay according to claim 1 wherein said connecting means includes an RC network.

4. An electrical relay for use in a circuit having alternating and direct current transmitted therealong, said electrical relay comprising:

electrical contact means;

centrally pivoted armature means adapted to control operation of said electrical contact means;

first and second core means associated respectively with opposite ends of said armature means;

first coil means coupled to said first core means and adapted to be connected in series with the circuit and operable when direct current flows therein to move said armature means toward said first core means and operate said electrical contact means;

second coil means associated with said second core means and adapted to be connected in parallel with the circuit and operable when alternating current flows therein to oppose the operation of said first coil means thereby causing said armature means to remain stationary; and means included with said second coil means to block flow of direct current thereto thereby enabling said first coil means to be operable to move said armature means toward said first core means.

5. An electrical relay according to claim 4 wherein said armature means has an H configuration.

6. An electrical relay according to claim 4 wherein said first coil means includes bifilar winding means.

7. An electrical relay according to claim 4 wherein said second coil means comprises single winding means.

8. An electrical relay according to claim 4 wherein said means included with said second coil means comprises and RC network.

* * * * *